US008907856B2

(12) United States Patent
Fehr et al.

(10) Patent No.: US 8,907,856 B2
(45) Date of Patent: Dec. 9, 2014

(54) ANTENNA UNIT FOR WIRELESS AUDIO TRANSMISSION

(75) Inventors: Matthias Fehr, Baiersdorf (DE); Klaus Willemsen, Wedemark (DE); Sven Dortmund, Hannover (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 907 days.

(21) Appl. No.: 12/896,653

(22) Filed: Oct. 1, 2010

(65) Prior Publication Data

US 2011/0080328 A1 Apr. 7, 2011

(30) Foreign Application Priority Data

Oct. 5, 2009 (DE) ..... 10 2009 048 229

(51) Int. Cl.
*H01Q 9/40* (2006.01)
*H01Q 1/00* (2006.01)

(52) U.S. Cl.
CPC ... *H01Q 9/40* (2013.01); *H01Q 1/00* (2013.01)
USPC ..... 343/720; 343/700 MS

(58) Field of Classification Search
CPC ..... H01Q 1/00; H01Q 1/22; H01Q 1/48; H01Q 9/40; H01Q 13/00; H01Q 13/0225; H01Q 13/02
USPC ..... 343/700 MS, 720
See application file for complete search history.

(56) References Cited

U.S. PATENT DOCUMENTS

| | | | | |
|---|---|---|---|---|
| 5,200,756 | A | 4/1993 | Feller | |
| 5,319,378 | A | 6/1994 | Nalbandian et al. | |
| 6,072,437 | A | 6/2000 | Zimmerman et al. | |
| 6,329,959 | B1 | 12/2001 | Varadan et al. | |
| 6,567,048 | B2 | 5/2003 | McKinzie et al. | |
| 7,400,298 | B2 * | 7/2008 | Fogg et al. | 343/700 MS |
| 2006/0012524 | A1 | 1/2006 | Mierke et al. | |
| 2008/0186238 | A1 * | 8/2008 | Noro et al. | 343/700 MS |

FOREIGN PATENT DOCUMENTS

| | | | |
|---|---|---|---|
| EP | 0 537 548 | A1 | 4/1993 |
| GB | 2 393 076 | A | 3/2004 |
| JP | 05-014042 | A | 1/1993 |
| JP | 2003-234617 | A | 8/2003 |
| JP | 2005-020598 | A | 1/2005 |
| JP | 2007-143089 | A | 6/2007 |
| KR | 20050036595 | A | 4/2005 |
| WO | WO2007/029279 | A1 | 3/2007 |

OTHER PUBLICATIONS

"Patch antenna" Wikipedia entry (Jun. 2008).
The European Search Report for Application No. GB1016259.2, mailed Jan. 24, 2011, 4 pages.
Examination Report for United Kingdom patent application GB1016259.2 (Jun. 20, 2012).

* cited by examiner

*Primary Examiner* — Dameon E Levi
*Assistant Examiner* — Jennifer F Hu
(74) *Attorney, Agent, or Firm* — Kilpatrick Townsend & Stockton LLP

(57) ABSTRACT

There is provided an antenna unit comprising a first metallic main surface (100, 500) for placement of the antenna unit on a substantially planar surface, a second main surface (200, 600), a first end and a second end. The first end has a first and a second metallic side surface (610, 620) and a connection (710) for a feed line of the antenna unit. The second end has a third side surface (630). The second main surface is smaller than the first main surface. The first, second and third side surfaces extend between the first and second main surfaces.

8 Claims, 2 Drawing Sheets

ANTENNA UNIT FOR WIRELESS AUDIO TRANSMISSION

CROSS-REFERENCE TO RELATED APPLICATIONS

Figure 1A:
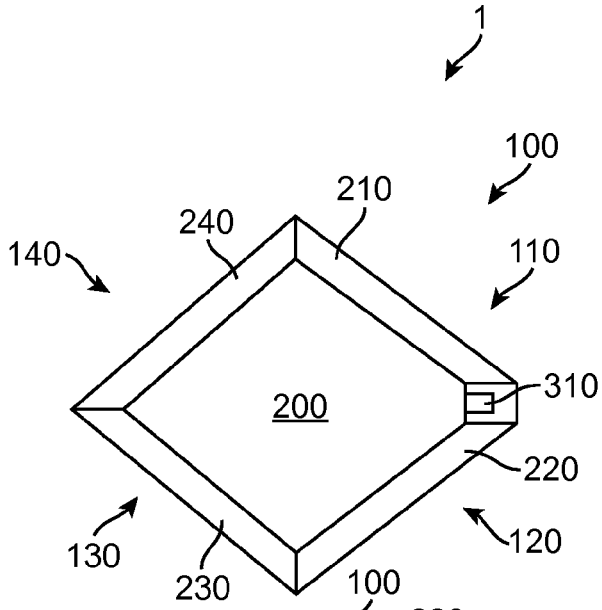

The present application is a non-provisional application of and claims priority to German Patent Application No. 10 2009 048 229.6 filed Oct. 5, 2009, the entire contents of which are herein incorporated by reference for all purposes.

The present invention concerns an antenna unit for wireless audio transmission.

Antennas represent a central component of wireless audio transmission systems. Depending on the propagation distance the structural configuration and the antenna forms used have a direct influence on the reliability of wireless transmission. For wireless audio transmission antennas are typically fixed on a carrier device such as for example stands or holding structures on walls or the ceiling of a room. Conventional directed and also omnidirectional antenna arrangements must in that situation be at a favorable spacing relative to the floor, roofs, walls or ceilings of a room in order to achieve the desired antenna properties.

An object of the present invention is to provide an antenna unit for wireless audio transmission involving a small profile height, which can be operated on a very substantially flat surface such as for example a stage floor.

That object is attained by an antenna unit as set forth in claim 1.

Thus there is provided an antenna unit for wireless audio transmission, which for brevity can also be referred to as the antenna, comprising a first metallic main surface for placement of the antenna unit on a substantially planar surface, a second main surface, a first end and a second end. The first end has a first and a second metallic side surface and a connection for a feed line of the antenna unit and/or an opening. The second end has at least one third side surface. The second main surface is smaller than the first main surface. The first, second and third side surfaces and/or the opening extend between the first and second main surfaces. The second main surface can also be referred to as the radiating means.

In an aspect of the present invention the first and second metallic side surfaces converge at a predetermined angle, in particular 90°, at the first end.

In a further aspect of the invention the third, non-metallic side surface is of a semicircular or triangular configuration in plan view.

In a further aspect of the invention the connection is provided in the region of the interface between the first and second side surfaces.

In a further aspect of the invention the second main surface is arranged parallel to the first main surface.

In a further aspect of the invention the antenna unit has a preferential radiation inclinedly upwardly in the direction of the non-metallic side surfaces.

In a further aspect of the invention the antenna unit has a front-to-back ratio for reducing electromagnetic radiation by way of the first main surface of the antenna unit.

In a further aspect of the invention the housing of the antenna unit represents a stable structure which can be walked upon, driven upon and/or built upon.

The invention also concerns a wireless audio transmission system comprising an antenna unit as described hereinbefore for wireless audio transmission and at least one wireless receiver and/or wireless transmitter.

The invention concerns the notion of providing a floor antenna for wireless audio transmission. In that case the floor antenna represents an implementation of a patch antenna having metallic side surfaces. In that case the mechanical structure of the floor antenna is such that it is suitable for use on the floor or a planar surface independently of its material and nature and with a low profile height also has a bandwidth which is sufficiently great for wireless audio transmission.

In accordance with the invention there is also proposed a process for the production of an antenna unit. In accordance therewith an antenna unit having a first and a second metallic main surface and a first and a second metallic side surface is produced. Those two main surfaces and the two side surfaces are arranged in accordance with the requirements involved in one step. In other words, their arrangement is implemented in such a way as will later be the case in the finished antenna unit. In that respect a cavity is formed between those four surfaces, with the cavity being open. The cavity can be for example in the form of an element in the shape of a quarter of a circle of a given, in particular thin, thickness.

In a next step that cavity can optionally be entirely or partially filled with an electrically non-conducting, mechanically resistant material. That produces a mechanically stable connection at least between the first and second main surfaces. In other words a force which for example is applied to the second main surface by walking thereon is passed to the first main surface by way of the electrically non-conducting mechanically resistant material. In particular the spacing and the arrangement of the two main surfaces relative to each other should be maintained, in spite of mechanical loadings on the antenna unit. Although partial filling of the cavity may be sufficient, preferably the cavity is completely filled so that from a mechanical point of view the antenna unit basically forms a strong solid body.

Contacting of the surfaces of the antenna unit can be effected prior to or after the operation of filling of the cavity with the resistant material.

Preferably the cavity can be at least partially sealed off prior to the filling operation in order then to entirely or partially teem the cavity with a hardenable material, in particular a casting resin. A casting resin as is also known for example from transformers or other electrical apparatuses can afford mechanical stability for the antenna unit and in that case in the pouring filling operation can adapt to the shape of the cavity. Preferably contactings in so far as they are at any event provided within the cavity are implemented prior to the filling operation and the fluid hardenable substance or material can also be disposed around such elements for contacting purposes.

The third or further non-metallic side surface can be formed by the material which is to be introduced into the cavity. That applies both to the hardenable material which is hardened in the finished condition and also materials which are already introduced in a solid condition. Post-treatment of the material to be used for the filling in the region of the third or further non-metallic side surface can optionally be implemented.

The first and/or second main surface as well as the first and/or the second side surface can be respectively formed by a metal plate.

In accordance with the invention there is also proposed a process for the production of an antenna unit, in accordance with which firstly a mechanically resistant filling body is produced. In that respect production refers in particular to cutting to size, that is to say generally adapting a suitably hard material to the size of the respective internal region to be filled, in the antenna unit to be produced. Thus in the finished condition the antenna unit has a first and a second main surface and a first and a second side surface which provide a region which however is open to at least one side. An electrically non-conducting, mechanically resistant filling body is thus adapted to the configuration and size of that future internal region. In that respect it is possible to produce the filling body in different ways, such as for example cutting from an existing piece or casting in a mold or making it up from a plurality of layers, to mention just some examples.

When that filling body is finished it at least partially predetermines the shape of the internal region. Openings or the like can possibly be present in the filling body in relation to the internal region. The first and second metallic main surfaces and the first and second metallic side surfaces are then fixed to that existing solid filling body. The filling body can thus serve as a load-bearing base for those surfaces. The surfaces themselves do not need to be capable of bearing a load, on their own, without the filling body. Considerations of mechanical stability of the main and side surfaces can possibly be pushed into the background in regard to further construction of the antenna unit.

Preferably one or more of the first and second metallic main surfaces and first and second metallic side surfaces can be applied by means of a metallic lacquer. Accordingly the necessary flat configuration is afforded by the corresponding surface of the filling body, to which such a lacquer would be applied, which could also be effected by dipping. Equally one or more of said surfaces can be produced by a metallic foil. For example a respective stable metal plate can be used for the first metallic main surface and the second metallic main surface so that both withstand direct loadings caused by standing thereon, whereas the side surfaces can each be formed from a mechanically weaker layer such as for example a thin metal plate, a metallic foil or a metallic lacquer layer.

A third or further non-metallic side of the antenna unit can be formed by a corresponding side of the filling body or it is additionally added.

In addition there is proposed a stage element which includes a part of a stage, in particular a floor element of a stage, and an antenna unit as described hereinbefore. In this context a stage concerns in particular a stage for productions such as a theater stage or in particular a stage for musical performances including singing performances. Essentially such a stage can form an elevated platform on which a said performance takes place. Such a stage is thus prepared for people to stand, walk, run and/or move in other ways thereon. In that respect it is proposed that the antenna unit is adapted to a part of the stage, in particular the floor element, and is preferably fixedly connected thereto. Such adaptation can already involve the antenna unit being fixed flat on top on the stage. The top side of the antenna unit can thus form a part of the floor of the stage. People on the stage can thus directly walk on the antenna unit, in particular the second main surface thereof. In that respect the antenna unit can also be easily let into the stage floor so that the antenna unit is not raised in relation to the stage floor, that is to say the stage floor and the top side of the antenna unit form substantially one plane.

A floor element for the production of a floor which can be walked upon is also proposed. Such a floor element can also be used for producing a stage floor that can be walked upon, or another floor. That floor element includes an antenna unit as described hereinbefore, wherein the floor element has a tread surface for walking upon and the second main surface of the antenna unit forms entirely or partially at least a part of the tread surface. The second main plate is thus entirely or partially accessible from the exterior. In that respect it can be part of the tread surface of the floor element or however it can form the entire tread surface thereof. In other words the antenna unit as described hereinbefore could also be used overall as a floor element. The second main surface then forms a tread surface or at least a support layer thereof if for example a coating such as for example a slip-resistant covering is also provided thereon.

A stage element can thus be part of a stage or can form the stage overall. The antenna unit can correspondingly form part of the stage floor by being arranged flat thereon or also let into same. The antenna unit can also be fixed to another object of the stage, or can form a part thereof, such as for example a wall element, a seat element, such as for example a fixed bench, or a stairs element, or also another accessory such as for example a radiating device, a facing or a mirror, to name just some examples.

The antenna unit can be fitted into the stage unit or into the floor element, it can be let thereinto and/or cast thereinto.

Further configurations of the invention are subject-matter of the appendant claims.

Embodiments and advantages of the invention are described in greater detail hereinafter with reference to the drawing.

Figure 1B:
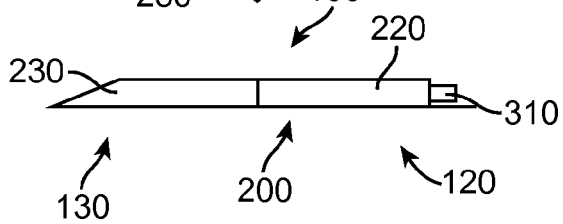
Figure 2A:
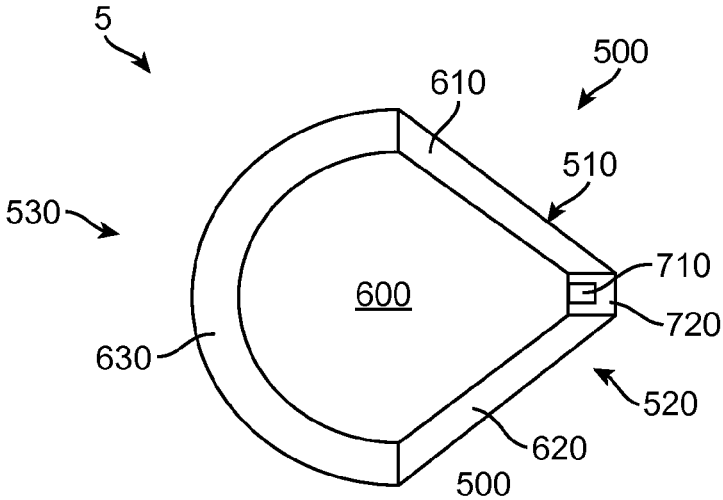
Figure 2B:
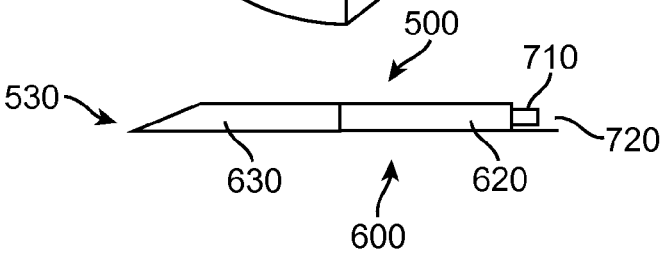
Figure 3:
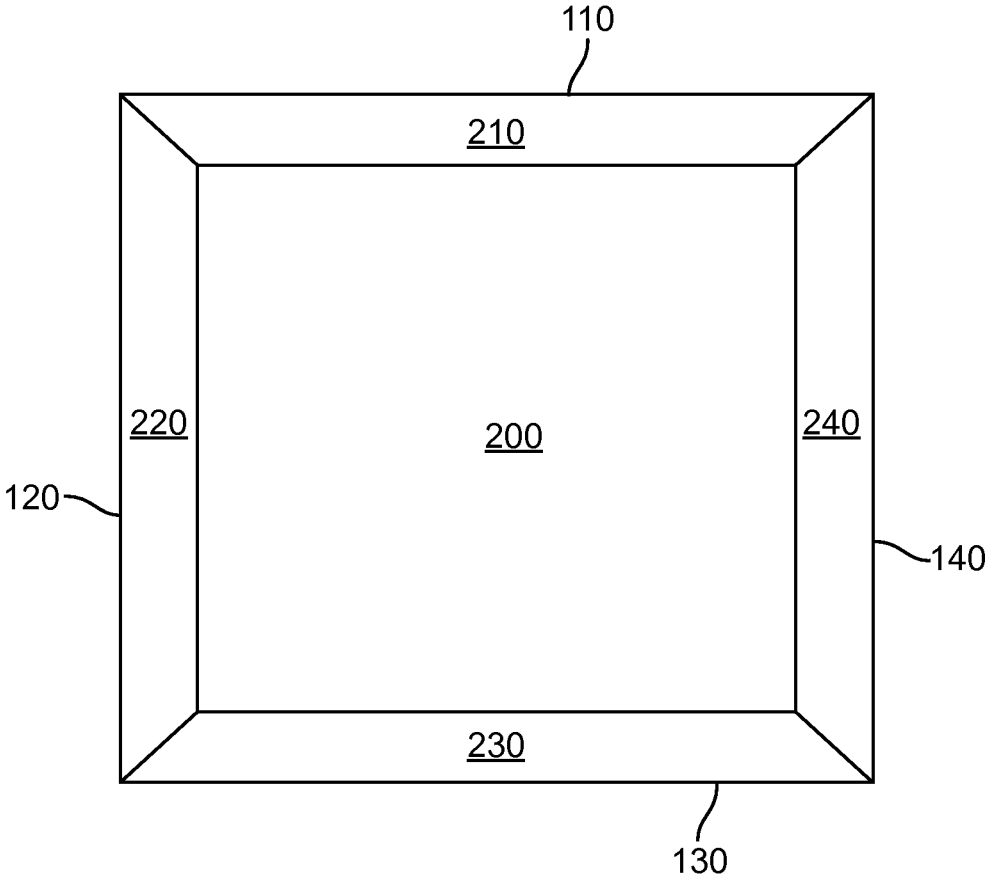

FIG. 1*a* shows a diagrammatic plan view of an antenna unit in accordance with a first embodiment, FIG. 1*b* shows a diagrammatic side view of an antenna unit in accordance with the first embodiment, FIG. 2*a* shows a diagrammatic plan view of a floor antenna in accordance with a second embodiment, FIG. 2*b* shows a diagrammatic side view of a floor antenna in accordance with the second embodiment, and FIG. 3 shows a diagrammatic plan view of an antenna unit of a further embodiment.

FIG. 1*a* shows a diagrammatic plan view and FIG. 1*b* shows a side view of an antenna unit 1 according to a first embodiment. The Figure shows an antenna unit 1 having a basic shape or main surface 100. The main surface 100 has a first, second, third and fourth side 110, 120, 130 and 140. The antenna unit has a first and a second metallic side surface or edge 210 and 220 and a third and a fourth non-metallic side surface or edge 230 and 240. The antenna also has a substantially planar upper termination 200 or a second metallic main surface 200. The radiating means can be of a curved or planar configuration. The antenna unit further has a connection 310 for a feed line.

FIG. 3 shows a plan view of an antenna unit similar to FIGS. 1*a* and 1*b*, with the same references being used for similar elements.

FIG. 2*a* shows a plan view and FIG. 2*b* a side view of an antenna unit 5 or a floor antenna in accordance with a second embodiment. The antenna unit 5 has a first end of a substantially triangular configuration and a second end of a substantially drop-shaped or semicircular configuration. The antenna unit 5 has a main surface 500 with a first and a second side surface 510, 520. The first and second side surfaces 510, 520 represent a metallic side surface or edge. In addition at the second end the antenna unit 5 has a third side surface 530 which is also inclined and has a side wall 630. The third side surface 530 or the second end is in this case of a substantially semicircular configuration in plan view. The third side surface 530, 630 is of a non-metallic nature. Provided parallel to the main surface 500 is a second smaller metallic cover surface or main surface 600. A connection 710 for a feed line can be provided at the first end of the antenna unit between the first and second side surfaces 510, 520.

By way of example the edge length of the first and second side surfaces 510, 520 can each be about 100 mm. The edge length of the third side surface 530 can be about 200 mm and the height of the antenna unit or the side surfaces can in that case be about 15 mm. The dimensions of the antenna unit 100 may turn out to be similar.

The antenna unit thus has a first main surface 500 and a second smaller main surface 600 arranged parallel thereto. Provided at a first end of the antenna unit are two inclined side surfaces 610, 620 which meet at a predetermined angle, for example 90°. Provided at the second end of the antenna unit is a third side surface 630 of a substantially semicircular configuration in plan view. In that respect the third side surface 630 is also of an inclined configuration like the first and second side surfaces 610, 620.

A connection 710 for a feed line for the antenna is also shown. At the first end of the floor antenna an opening 720 is provided in the region where the first and second side surfaces 610, 620 meet. The connection 710 for the feed line is provided in the region of the opening.

The configuration of the housing of an antenna unit, that is shown in FIGS. 1*a*, 1*b*, 2*a* and 2*b*, can provide an antenna unit which can also be placed on the floor or a planar surface of any material and of any area extent, insofar as it is only larger than that of the antenna unit. The specific configuration makes it possible to achieve a high level of strength for standing thereon and the risk potential typical for articles on the ground can be reduced. The low profile height also provides a low risk potential due to the antenna unit. The housing of the antenna unit can be afforded by a metal structure. In addition to the metal structure there can be a stable, non-conducting solid material, a layer material or a material mixture in the interior of the housing.

Although the Figures only show a configuration of the antenna unit which in plan view is quadrangular or drop-shaped or semicircular with four straight or two straight and a circular boundary edge, the antenna unit can also be of a polygonal, ellipsoidal or cylindrical configuration.

The antenna unit according to the invention can provide an efficient antenna which can be used on floors or stages, gangways, roads, sports grounds or playing fields, grass or other flat surfaces. The structure shown for example in FIG. 1 or FIG. 2 can provide a stable housing for the antenna unit, which can be walked upon, driven upon or built upon. It should be pointed out that this is also possible in the case of a polygonal or ellipsoidal configuration.

The configuration of the antenna unit, for example by virtue of the inclined surfaces or edges as well as the planar upper portion can provide a structure with a desired load-bearing capability both for loads which are applied perpendicularly and also transversely.

The antenna unit according to the invention can have a preference in respect of radiation inclinedly relative to the surface of the radiating means so that transmitting or receiving devices (such as for example wireless microphones, in-ear monitors etc) which are disposed straight or inclinedly above the antenna can enjoy very good reception.

A front-to-back ratio in the antenna unit can permit reduced electromagnetic irradiation or incoming radiation over the underside of the antenna.

A high ESD resistance and a high ability to withstand short-circuiting can be made possible by the configuration of the antenna.

The housing of the antenna unit 1 or 5 can have a water-repellent or water-tight covering or enclosure which can also be used as a writing, image or advertising carrier.

The antenna unit according to the invention can be in the form of a passive transmitting or receiving antenna or in the form of an active receiving antenna, in which case an additional electronic circuit is provided for same.

The antenna units according to the invention can have a transmitter and/or receiver with a planar or curved radiating means as well as an amplifier.

In accordance with an aspect of the invention there can be provided various or a plurality of antenna arrays in a floor antenna.

In a further aspect of the invention a plurality of floor antennas or a plurality of antenna units can be connected together to provide an antenna array.

In a further aspect of the invention the antenna units or the planar or curved radiating devices can be mechanically and/or electrically oriented. In that case the planar or curved radiating means can be wired in phase-dependent relationship and/or individually. The radiating means can also be electrically actuated individually. Alternatively or additionally thereto the individual radiating means can be electrically balanced.

The above-described antenna units can represent constituent parts of a floor element or a stage element.

The invention claimed is:

1. An antenna unit for wireless audio transmission comprising:

a first at least partially metallic main surface for placement of the antenna unit on a substantially planar surface;

a second at least partially metallic main surface, wherein the second main surface is arranged parallel to the first main surface, and wherein the second main surface is smaller than the first main surface;

a first end having a first and a second inclined side surface and a connection for a feed line of the antenna unit, wherein the first and second side surfaces converge at a predetermined angle at the first end and the connection is provided in the region of the interface between the first and second side surfaces; and a second end having at least one inclined third side surface, wherein the first and second side surfaces and the third side surface extend between the first and second main surfaces, and wherein the first and second side surfaces are entirely metallic and the third side surface is entirely non-metallic;

wherein the antenna unit has a preferential radiation inclined upwardly in the direction of the third side surface.

2. An antenna unit as set forth in claim 1 wherein the third, non-metallic side surface is of a semicircular configuration in plan view.

3. A wireless audio transmission system comprising:

an antenna unit as set forth in claim 1, and at least one wireless receiver or wireless transmitter.

4. A stage element comprising:

a part of a stage, in particular a floor element of the stage; and an antenna unit as set forth in claim 1, wherein the antenna unit is adapted to the part of the stage and in particular is fixedly connected thereto.

5. A floor element for producing a floor which can be walked upon, comprising an antenna unit as set forth in claim 1, wherein the floor element has a tread surface for walking upon and the second main surface of the antenna unit entirely or partially forms at least a part of the tread surface or a support layer for same.

6. An antenna unit comprising:

a first at least partially metallic main surface for placement of the antenna unit on a substantially planar surface;

a second at least partially metallic main surface, wherein the second main surface is arranged parallel to the first main surface, and wherein the second main surface is smaller than the first main surface;

a first end having a first and a second inclined side surface and a connection for a feed line of the antenna unit, wherein the first and second side surfaces converge at a predetermined angle at the first end; and a second end having at least one inclined third side surface, wherein the first and second side surfaces and the third side surface extend between the first and second main surfaces, and wherein the first and second side surfaces are entirely metallic and the third side surface is entirely non-metallic; and wherein the antenna unit has a preferential radiation inclined upwardly in the direction of the third side surface.

7. An antenna unit as set forth in claim 6 wherein the third, non-metallic side surface is of a semicircular configuration in plan view.

8. An antenna unit comprising:

a first at least partially metallic main surface for placement of the antenna unit on a substantially planar surface;

a second at least partially metallic main surface, wherein the second main surface is arranged parallel to the first main surface, and wherein the second main surface is smaller than the first main surface;

a first end having a first and a second inclined side surfaces and a connection for a feed line of the antenna unit, wherein the first and second metallic side surfaces converge at a predetermined angle at the first end; and a second end having at least one opening, wherein the first and second side surfaces and the opening extend between the first and second main surfaces, wherein the first and second side surfaces are entirely metallic, and wherein the antenna unit has a preferential radiation inclined upwardly in the direction of the opening.

* * * * *

UNITED STATES PATENT AND TRADEMARK OFFICE

CERTIFICATE OF CORRECTION

PATENT NO. : 8,907,856 B2
APPLICATION NO. : 12/896653
DATED : December 9, 2014
INVENTOR(S) : Matthias Fehr et al.

It is certified that error appears in the above-identified patent and that said Letters Patent is hereby corrected as shown below:

In the Claims:

In column 6, line 40, claim 1, please delete ";" after "is entirely non-metallic;" and add ", and" after "third side surface is entirely non-metallic, and wherein the antenna unit...".

In column 7, line 12, claim 6, please delete ";" after "is entirely non-metallic;" and add ", and" after "third side surface is entirely non-metallic, and wherein the antenna unit...".

Signed and Sealed this
Seventh Day of July, 2015

Michelle K. Lee

Michelle K. Lee
*Director of the United States Patent and Trademark Office*